US011709449B2

(12) United States Patent
Takeda et al.

(10) Patent No.: US 11,709,449 B2
(45) Date of Patent: Jul. 25, 2023

(54) FIXING DEVICE

(71) Applicant: BROTHER KOGYO KABUSHIKI KAISHA, Nagoya (JP)

(72) Inventors: Kengo Takeda, Tokai (JP); Yutaka Kakigahara, Nagoya (JP); Masamitsu Takahashi, Nagoya (JP); Satoshi Murata, Nagoya (JP); Masataka Kamiya, Owariasahi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/487,121

(22) Filed: Sep. 28, 2021

(65) Prior Publication Data

US 2022/0011699 A1 Jan. 13, 2022

Related U.S. Application Data

(63) Continuation of application No. PCT/JP2019/051139, filed on Dec. 26, 2019.

(30) Foreign Application Priority Data

Mar. 28, 2019 (JP) ..... JP2019-063971
Dec. 4, 2019 (JP) ..... JP2019-219837

(51) Int. Cl.
*G03G 15/20* (2006.01)

(52) U.S. Cl.
CPC ..... *G03G 15/2096* (2013.01); *G03G 15/20* (2013.01)

(58) Field of Classification Search
CPC .. G03G 15/2096; G03G 15/101; G03G 9/122; G03G 15/10
See application file for complete search history.

(56) References Cited

U.S. PATENT DOCUMENTS

2013/0287962 A1 10/2013 Deng et al.
2014/0205337 A1* 7/2014 Notoya ..... G03G 15/20 399/340

(Continued)

FOREIGN PATENT DOCUMENTS

EP 3 358 424 A1 8/2018
JP 49-6598 Y1 2/1974

(Continued)

OTHER PUBLICATIONS

International Preliminary Report on Patentability and translation of Written Opinion dated Sep. 28, 2021 received in International Application No. PCT/JP2019/051139.

(Continued)

*Primary Examiner* — Jessica L Eley
(74) *Attorney, Agent, or Firm* — Scully, Scott, Murphy & Presser, P.C.

(57) ABSTRACT

A fixing device 9 includes a nozzle unit 9A and an opposite electrode 9B. The nozzle unit 9A sprays a fixing solution to a sheet S on which a toner image is formed. The opposite electrode 9B is located at an interval from the nozzle unit 9A. The opposite electrode 9B is applied with a voltage. The opposite electrode 9B has a first flat plate 31 and a plurality of first projections 32. The first flat plate 31 extends in a first direction. The plurality of first projections 32 extends from the first flat plate 31 in a second direction that is a direction facing from the opposite electrode 9B toward the nozzle unit 9A. The plurality of first projections 32 are aligned in the first direction.

14 Claims, 12 Drawing Sheets

(56) References Cited

U.S. PATENT DOCUMENTS

| | | | | |
|---|---|---|---|---|
| 2017/0031262 | A1* | 2/2017 | Nishimura | G03G 15/0291 |
| 2018/0217543 | A1* | 8/2018 | Kakigahara | G03G 15/2096 |

FOREIGN PATENT DOCUMENTS

| | | | | | |
|---|---|---|---|---|---|
| JP | 9-156109 | A | | 6/1997 | |
| JP | 2013-146866 | A | | 8/2013 | |
| JP | 2017-68098 | A | | 4/2017 | |
| JP | 2017116783 | A | * | 6/2017 | G03G 15/20 |
| WO | 2017/057684 | A1 | | 4/2017 | |

OTHER PUBLICATIONS

International Search Report dated Feb. 10, 2020 received in International Application No. PCT/JP2019/051139, together with an English-language translation.

Extended European Search Report dated Sep. 9, 2022 from related EP 19921776.1.

* cited by examiner

FIXING DEVICE

CROSS-REFERENCE TO RELATED APPLICATION

This is a continuation application of International Application No. PCT/JP2019/051139 filed on Dec. 26, 2019 which claims the benefit of priority from Japanese patent applications No. 2019-063971 filed on Mar. 28, 2019 and No. 2019-219837 filed on Dec. 4, 2019. The entire contents of the earlier applications are incorporated herein by reference.

TECHNICAL FIELD

The present invention relates to a fixing device.

BACKGROUND

In the related art, a fixing device is provided to fix a toner image on a sheet. The fixing device includes a nozzle unit and an opposite electrode. The nozzle unit sprays a fixing solution onto a sheet on which the toner image is formed. The opposite electrode is located at an interval from the nozzle unit. A voltage is applied to the opposite electrode (refer to JP-A-2017-068098).

However, according to the fixing device disclosed in JP-A-2017-068098, mists of the fixing solution sprayed from nozzles are electrically charged. For this reason, the mists of the fixing solution are provided to the sheet, so that the sheet is electrically charged. When the fixing solution is additionally sprayed to the electrically charged sheet, an electrostatic repulsive force is generated between the mists of the fixing solution and the sheet, so that the mists of the fixing solution are difficult to be attracted to the sheet.

Therefore, it is difficult to stably provide the fixing solution to the sheet.

SUMMARY

It is therefore an object of the present disclosure to provide a fixing device capable of stably providing a fixing solution sprayed from each of a plurality of nozzles to a sheet even in a case where the sheet is electrically charged.

(1) A fixing device of the present disclosure is provided to fix a toner image on a sheet. The fixing device includes a nozzle unit and an opposite electrode. The nozzle unit sprays a fixing solution onto a sheet on which the toner image is formed. The opposite electrode is located at an interval from the nozzle unit. The opposite electrode is applied with a voltage.

The opposite electrode has a first flat plate and a plurality of first projections.

The first flat plate extends in a first direction.

The plurality of first projections extends from the first flat plate in a second direction. The second direction is a direction facing from the opposite electrode toward the nozzle unit. The plurality of first projections are aligned in the first direction.

According to the configuration, the plurality of first projections extend from the opposite electrode toward the nozzle unit.

Thereby, in a state where a voltage is applied to the opposite electrode, an electrostatic force is concentrated on a tip end of each of the plurality of first projections.

For this reason, it is possible to form a strong electric field at the tip end of each of the plurality of first projections without increasing the voltage applied to the opposite electrode.

The plurality of first projections are aligned in the first direction.

For this reason, it is possible to stably attract the fixing solution sprayed from each of the plurality of nozzles toward the opposite electrode by the strong electric field formed in the first direction.

As a result, even in a case where the sheet is electrically charged, it is possible to stably provide the fixing solution sprayed from each of the plurality of nozzles to the sheet.

(2) The nozzle unit may have a housing and a plurality of nozzles. The housing can accommodate the fixing solution. The plurality of nozzles are provided to discharge the fixing solution in the housing.

(3) The number of the plurality of first projections may be larger than the number of the plurality of nozzles.

(4) The plurality of first projections may include opposite projections and non-opposite projections. The opposite projections face the nozzles in the second direction. The non-opposite projections do not face the nozzles in the second direction.

(5) Each of the plurality of first projections may be tapered from the first flat plate toward the nozzle unit in the second direction.

(6) Each of the plurality of first projections may be an isosceles triangle flat plate.

(7) A tip end of each of the plurality of first projections may have an arc shape.

(8) The first direction and a third direction may intersect with each other. The third direction is a direction in which the sheet is conveyed from a photosensitive drum of an image forming apparatus toward the fixing device. The second direction may intersect with both the first direction and the third direction.

(9) The photosensitive drum may enable to rotate about an axis extending in the first direction.

(10) The opposite electrode may further have a second flat plate, a plurality of second projections, and a connection plate. The second flat plate is located at an interval from the first flat plate in the third direction. The second flat plate extends in the first direction. The plurality of second projections extend from the second flat plate toward the nozzle unit in the second direction. The plurality of second projections are aligned in the first direction. The connection plate is provided to electrically connect the first flat plate and the second flat plate.

(11) The opposite electrode may further have a connection terminal. The connection terminal is electrically connected to a power supply of an image forming apparatus. The connection terminal is located at one end portion of the opposite electrode in the first direction.

(12) A tip end of each of the plurality of first projections may be located between the nozzle unit and the connection terminal in the second direction.

(13) The fixing device may further include a frame, and an electrode. The frame has an accommodation unit. The accommodation unit has a bottom and a sidewall. The bottom wall is located on an opposite side to the nozzle unit with respect to the opposite electrode in the second direction. The sidewall extends from the bottom wall in the second direction. The accommodation unit can accommodate the fixing solution sprayed from the nozzle unit. The opposite electrode is attached to the bottom wall. The electrode is provided to apply a voltage to the opposite electrode. The electrode has a first terminal, and a second terminal. The first terminal is electrically connected to the opposite electrode inside the accommodation unit. The second terminal is located distant from the first terminal. The second terminal is electrically connected to a power supply of an image forming apparatus outside the accommodation unit. The sidewall has an opening. In a state where the electrode passes through the opening, the electrode is spaced from the sidewall.

According to the configuration, since the electrode is spaced from the sidewall, it is possible to suppress the sidewall from being electrically charged due to the voltage applied to the opposite electrode.

For this reason, it is possible to suppress mists of the fixing solution sprayed from the nozzle unit from being attracted to the sidewall.

As a result, the nozzle unit can stably spray the fixing solution toward the opposite electrode.

(14) A tip end of each of the plurality of first projections may be located between the nozzle unit and the first terminal in the second direction.

(15) The opposite electrode may be made of metal.

According to the fixing device of the present disclosure, even in a case where the sheet is electrically charged, it is possible to stably provide the fixing solution sprayed from each of the plurality of nozzles to the sheet.

DETAILED DESCRIPTION

1. Outline of Image Forming Apparatus

Figure 1:
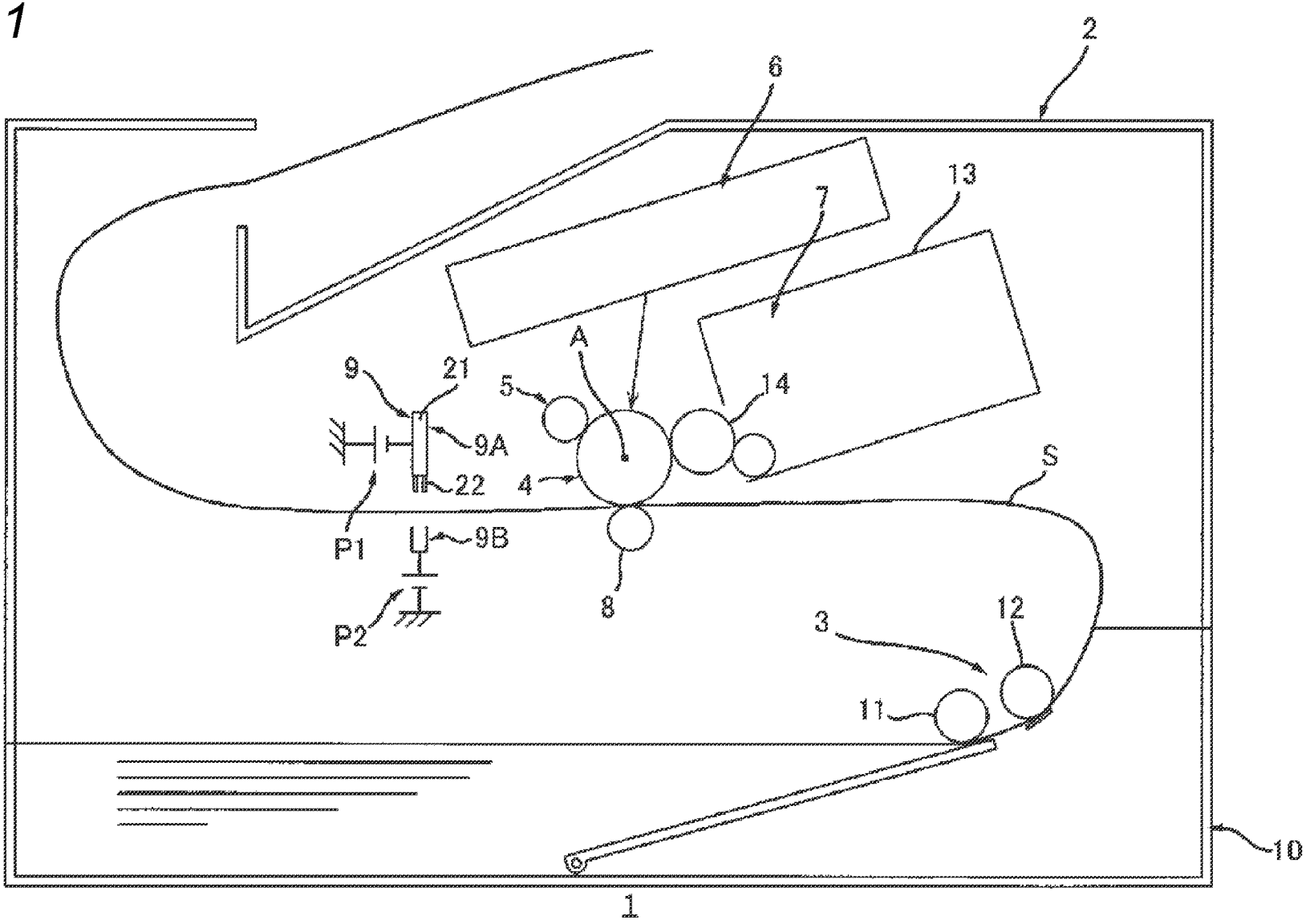
FIG. 1 is a schematic configuration view of an image forming apparatus.

An outline of an image forming apparatus 1 is described with reference to FIG. 1.

An image forming apparatus 1 includes a main body housing 2, a sheet feeding unit 3, a photosensitive drum 4, a charging device 5, an exposure device 6, a developing device 7, a transfer device 8, and a fixing device 9.

1.1 Main Body Housing

The main body housing 2 accommodates the sheet feeding unit 3, the photosensitive drum 4, the charging device 5, the exposure device 6, the developing device 7, the transfer device 8, and the fixing device 9.

1.2 Sheet Feeding Unit

The sheet feeding unit 3 feeds a sheet S to the photosensitive drum 4. The sheet feeding unit 3 includes a sheet cassette 10, a pickup roller 11, and a conveying roller 12. The sheet cassette 10 accommodates sheets S. The sheet S is, for example, a printing sheet. The pickup roller 11 conveys the sheet S in the sheet cassette 10 toward the conveying roller 12. The conveying roller 12 conveys the sheet S from the pickup roller 11 toward the photosensitive drum 4.

1.3 Photosensitive Drum

The photosensitive drum 4 can rotate about an axis A. The axis A extends in a first direction. The photosensitive drum 4 has a cylindrical shape. The photosensitive drum 4 extends along axis A.

1.4 Charging Device

The charging device 5 electrically charges a surface of the photosensitive drum 4. The charging device 5 is, specifically, a charging roller. Note that, the charging device 5 may also be a scorotron-type charger. In a case where the charging device 5 is a charging roller, the charging device 5 is in contact with the surface of the photosensitive drum 4. In a case where the charging device 5 is a scorotron-type charging device, the charging device 5 is located at an interval from the surface of the photosensitive drum 4.

1.5 Exposure Device

The exposure device 6 exposes the surface of the photosensitive drum 4. Specifically, the exposure device 6 exposes the surface of the photosensitive drum 4 electrically charged by the charging device 5. Thereby, an electrostatic latent image is formed on the surface of the photosensitive drum 4. The exposure device 6 is, specifically, a laser scan unit. Note that, the exposure device 6 may also be an LED array.

1.6 Developing Device

The developing device 7 supplies toner to the surface of the photosensitive drum 4. Thereby, the electrostatic latent image is developed, so that a toner image is formed on the surface of the photosensitive drum 4. The developing device 7 includes a toner accommodation unit 13 and a developing roller 14.

The toner accommodation unit 13 accommodates toner. Toner contains toner particles, and as required, an external additive. The toner particles contain a binding resin, and as required, a colorant, a pigment dispersant, a mold release agent, a magnetic material and a charge control agent. The binding resin is a base of the toner particles. The binding resin binds the components contained in the toner particles. The colorant imparts a desired color to the toner particles. The colorant is dispersed in the binding resin. The pigment dispersant improves dispersibility of the colorant. The charge control agent gives chargeability to the toner particles. The chargeability may be any of positive chargeability and negative chargeability. The external additive regulates chargeability, flowability and storage stability of the toner particles.

The developing roller 14 supplies toner in the toner accommodation unit 13 to the surface of the photosensitive drum 4. The developing roller 14 is in contact with the photosensitive drum 4. Note that, the developing roller 14 may not be in contact with the photosensitive drum 4.

The developing device 7 may be constituted as one process unit, together with the photosensitive drum 4 and the charging device 5. The process unit can be mounted to the main body housing 2.

In addition, the developing device 7 may be a developing cartridge that can be mounted to a drum unit having the photosensitive drum 4 and the charging device 5. The drum unit can be mounted to the main body housing 2.

The developing device 7 may also have a developing unit having the developing roller 14, and a toner cartridge that can be mounted to the developing unit. In this case, the toner cartridge has the toner accommodation unit 13. In addition, the developing unit may be provided to the drum unit. The developing unit can be mounted to the drum unit.

1.7 Transfer Device

The transfer device 8 transfers the toner image from the photosensitive drum 4 to the sheet S. Thereby, the toner image is formed on the sheet S. The transfer device 8 is in contact with the photosensitive drum 4. Note that, the transfer device 8 may not be in contact with the photosensitive drum 4. The transfer device 8 is, specifically, a transfer roller. Note that, the transfer device 8 may also be a transfer belt.

1.8 Fixing Device

The fixing device 9 provides a fixing solution to the toner image to fix the toner image on the sheet S. Specifically, the fixing device 9 sprays the fixing solution toward the toner image on the sheet S by electrostatic spraying, thereby providing the fixing solution to the toner image. Then, the binding resin of the toner is softened by the fixing solution. Thereafter, the softened binding resin is cured, so that the toner is fixed on the sheet S. Thereby, the toner image is fixed on the sheet S. The sheet S on which the toner image is fixed is discharged outside the main body housing 2.

2. Details of Fixing Device

Subsequently, details of the fixing device 9 are described with reference to FIGS. 1 to 4B.

As shown in FIG. 1 the fixing device 9 includes a nozzle unit 9A and an opposite electrode 9B.

2.1 Nozzle Unit

Figure 2:
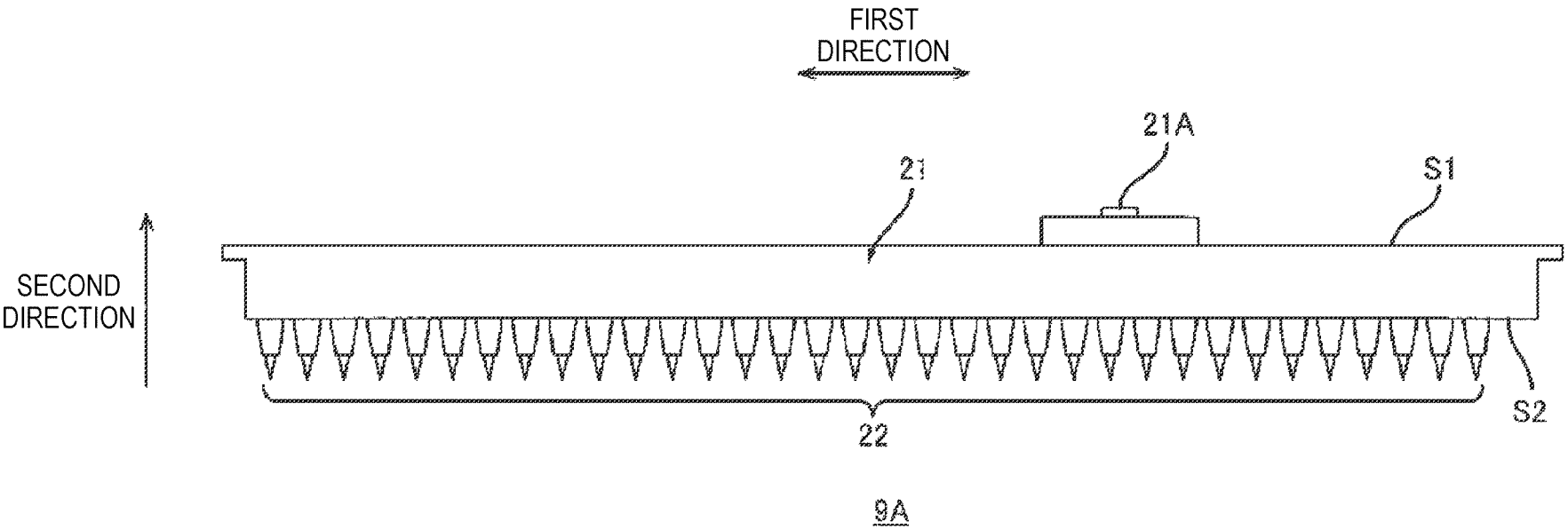
FIG. 2 is a side view of a nozzle unit shown in FIG. 1, as seen in a third direction.

The nozzle unit 9A sprays the fixing solution to a sheet S on which a toner image is formed. As shown in FIG. 2, the nozzle unit 9A includes a housing 21, and a plurality of nozzles 22.

2.1.1 Housing

The housing 21 can accommodate the fixing solution. The housing 21 extends in the first direction. The first direction is a direction in which the axis A of the photosensitive drum 4 extends. The first direction is also a width direction of the sheet S. The housing 21 has an outer surface S1 and an outer surface S2 in a second direction. The second direction is a direction facing from the opposite electrode 9B (refer to FIG. 1) toward the nozzle unit 9A. The second direction intersects with the first direction. Specifically, the second direction is orthogonal to the first direction. The outer surface S2 is located distant from the outer surface S1 in the second direction. The outer surface S2 is located closer to the opposite electrode 9B than the outer surface S1 in the second direction. The housing has a nozzle electrode 21A.

The nozzle electrode 21A is electrically connected to a power supply P1 (refer to FIG. 1) of the image forming apparatus 1. Thereby, the nozzle electrode 21A is applied with a voltage. The fixing solution in the housing 21 is electrically charged by the nozzle electrode 21A.

2.1.2 Nozzle

The plurality of nozzle 22 is located on the outer surface S2 of the housing 21. The plurality of nozzles 22 is located between the nozzle electrode 21A the opposite electrode 9B (refer to FIG. 1) in the second direction. Each of the plurality of nozzles 22 extends from the outer surface S2 of the housing 21 toward the opposite electrode 9B. Each of the plurality of nozzles 22 extends in the second direction. The plurality of nozzles 22 discharge the fixing solution in the housing 21. Specifically, in a state where a voltage is applied to the nozzle electrode 21A and the opposite electrode 9B, the fixing solution passing through the tip ends of the nozzles 22 is misted by an electrostatic force between the nozzle electrode 21A and the opposite electrode 9B. The misted fixing solution is provided to the sheet S (refer to FIG. 1) passing between the nozzle unit 9A and the opposite electrode 9B.

2.2 Opposite Electrode

Figure 3A:
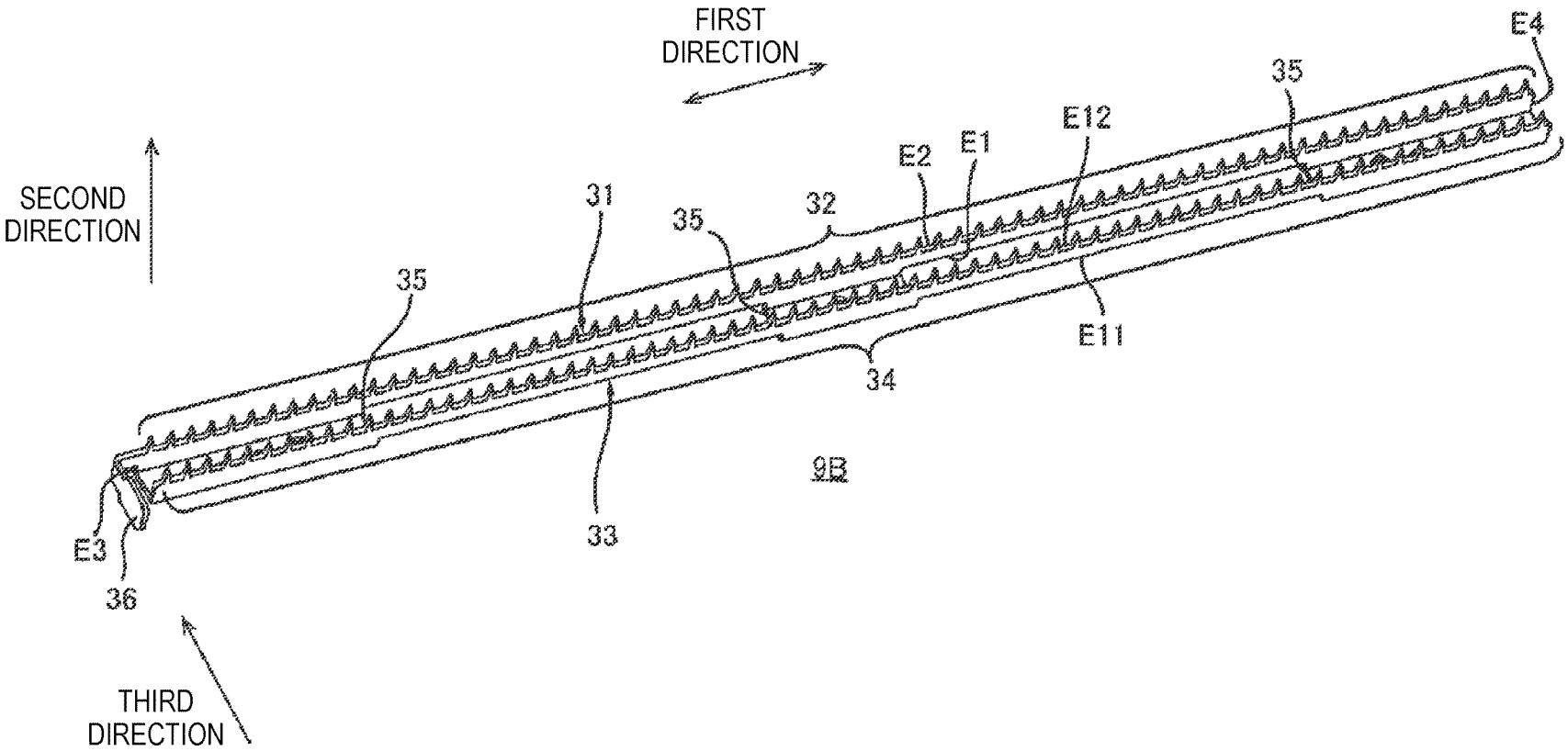
FIG. 3A is a perspective view of an opposite electrode shown in FIG. 1.

As shown in FIG. 1, the opposite electrode 9B is located at an interval from the nozzle unit 9A in the second direction. The opposite electrode 9B is made of metal. As shown in FIG. 3A, the opposite electrode 9B has a first flat plate 31, a plurality of first projections 32, a second flat plate 33, a plurality of second projections 34, a plurality of connection plates 35 and a connection terminal 36.

2.2.1 First Flat Plate

The first flat plate 31 extends in the first direction and in the second direction. The first flat plate 31 has an edge E1 and an edge E2 in the second direction. The edge E2 is located distant from the edge E1 in the second direction. The edge E2 is located closer to the nozzle unit 9A (refer to FIG. 1) than the edge E1 in the second direction. Also, the first flat plate 31 has an edge E3 and an edge E4 in the first direction. The edge E4 is located distant from the edge E3 in the first direction.

2.2.2 First Projection

Figure 4A:
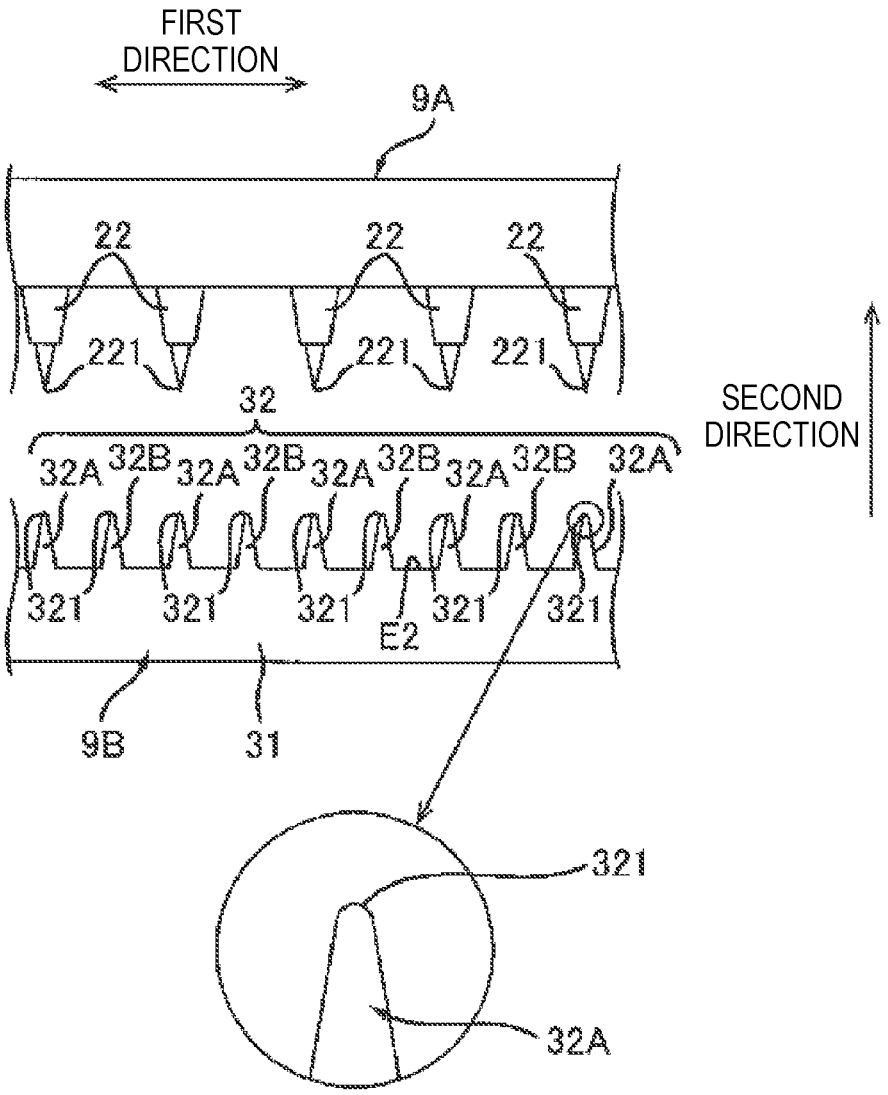
FIG. 4A illustrates a positional relationship between a plurality of nozzles and a plurality of first projections, as seen in the third direction.

As shown in FIG. 4A, each of the plurality of first projections 32 extends from the edge E2 of the first flat plate 31 in the second direction. Thereby, in a state where a voltage is applied to the opposite electrode 9B, an electrostatic force is concentrated on a tip end 321 of each of the plurality of first projections 32. For this reason, it is possible to form a strong electric field at the tip end 321 of each of the plurality of first projections 32 without increasing the voltage that is applied to the opposite electrode 9B. Specifically, each of the plurality of first projections 32 is tapered from the first flat plate 31 toward the nozzle unit 9A in the second direction. Thereby, the electrostatic force is more concentrated on the tip end 321 of each of the plurality of first projections 32. Specifically, each of the plurality of first projections 32 is an isosceles triangle flat plate. Note that, each of the plurality of first projections 32 may also have a conical shape. The tip end 321 of each of the plurality of first projections 32 has an arc shape.

A length of each of the plurality of first projections 32 in the second direction is, for example, 1 mm or greater, preferably 2 mm or greater. The length of each of the plurality of first projections 32 in the second direction is, for example, 10 mm or less.

Figure 3B:
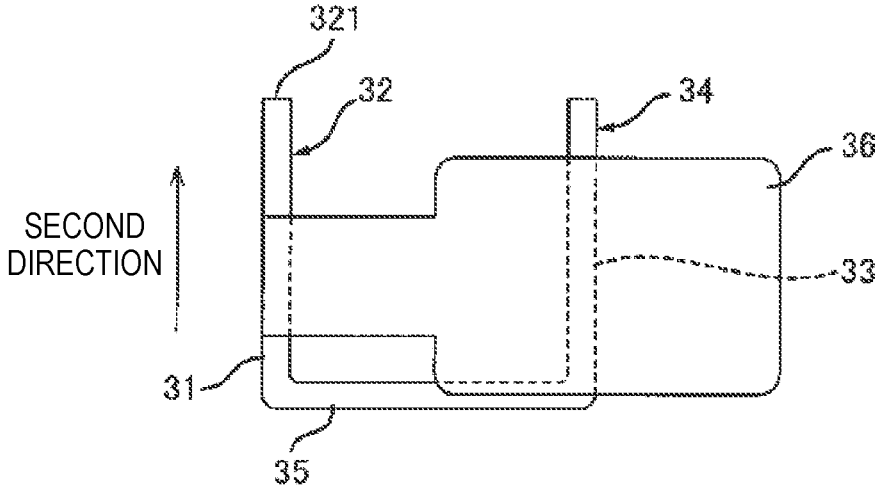
FIG. 3B is a side view of the opposite electrode shown in FIG. 3A, as seen in a first direction.

As shown in FIG. 3B, the tip end 321 of each of the plurality of first projections 32 is located between the nozzle unit 9A (refer to FIG. 4A) and the connection terminal 36 in the second direction. For this reason, in the state where the voltage is applied to the opposite electrode 9B, the fixing solution sprayed from each of the plurality of nozzles 22 (refer to FIG. 4A) is more attracted to the tip end 321 of each of the plurality of first projections 32 than the connection terminal 36.

As shown in FIG. 4A, the plurality of first projections 32 are aligned at intervals in the first direction. Thereby, in the state where the voltage is applied to the opposite electrode 9B, the strong electric field is formed in the first direction.

Figure 4B:
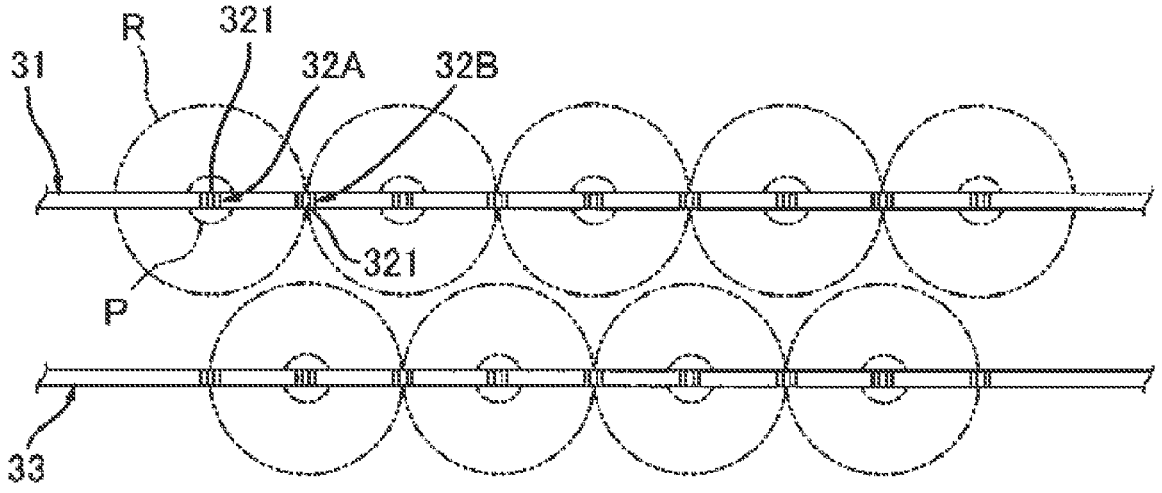
FIG. 4B illustrates the positional relationship between the plurality of nozzles and the plurality of first projections, as seen in a second direction.

Note that, an interval in the first direction between the two adjacent first projections 32 is preferably smaller than an interval in the first direction between the two adjacent nozzles 22. The interval in the first direction between the two adjacent first projections 32 is, for example, 10 mm or less, preferably 5 mm or less. The interval in the first direction between the two adjacent first projections 32 is, for example, 2 mm or greater. The number of the plurality of first projections 32 is larger than the number of the plurality of nozzles 22. Thereby, the fixing solution sprayed from the plurality of nozzles 22 can be securely attracted toward the opposite electrode 9B. The plurality of first projections 32 includes opposite projections 32A that face the nozzles 22 in the second direction, and non-opposite projections 32B that do not face the nozzles 22 in the second direction. As shown in FIG. 4B, the tip end 321 of the opposite projection 32A is within a projection plane P when projecting the nozzle 22 in the second direction. Preferably, the tip end 321 of the opposite projection 32A is matched with a tip end 221 of the nozzle 22 when projecting the nozzle 22 in the second direction. On the other hand, the tip end 321 of the non-opposite projection 32B is not within the projection plane P when projecting the nozzle 22 in the second direction. The tip end 321 of the non-opposite projection 32B is within a range R in which the fixing solution is sprayed from the nozzle 22.

2.2.3 Second Flat Plate

As shown in FIG. 3A, the second flat plate 33 is located distant from the first flat plate 31 in a third direction. The third direction is a direction in which the sheet S (refer to FIG. 1) is conveyed from the photosensitive drum 4 (refer to FIG. 1) of the image forming apparatus 1 toward the fixing device 9 (refer to FIG. 1). The third direction intersects with both the first direction and the second direction.

The second flat plate 33 extends in the first direction and in the second direction. The second flat plate 33 has an edge E11 and an edge E12 in the second direction. The edge E12 is located distant from the edge E11 in the second direction. The edge E12 is located closer to the nozzle unit 9A (refer to FIG. 1) than the edge E11 in the second direction.

2.2.4 Second Projection

Each of the plurality of second projections 34 extends from the edge E12 of the second flat plate 33 toward the nozzle unit 9A in the second direction. Each of the plurality of second projections 34 has the same shape as each of the plurality of first projections 32. Thereby, each of the plurality of second projections 34 has the same function as each of the plurality of first projections 32. The plurality of second projections 34 are aligned at intervals in the first direction.

2.2.5 Connection Plate

Each of the plurality of connection plates 35 extends in the first direction and in the third direction. One end portion of each of the plurality of connection plates 35 in the third direction is connected to the edge E1 of the first flat plate 31. In addition, the other end portion of each of the plurality of connection plates 35 in the third direction is connected to the edge E11 of the second flat plate 33. Each of the plurality of connection plates 35 is provided to electrically connect the first flat plate 31 and the second flat plate 33 each other. Thereby, in the state where the voltage is applied to the opposite electrode 9B, a voltage of the first flat plate and a voltage of the second flat plate are the same. The plurality connection plates 35 are aligned at intervals in the first direction.

2.2.6 Connection Terminal

The connection terminal 36 is located at one end portion of the opposite electrode 9B in the first direction. Specifically, the connection terminal 36 extends from the edge E3 of the first flat plate 31. The connection terminal 36 is electrically connected to a power supply P2 (refer to FIG. 1) of the image forming apparatus 1.

Figure 5:
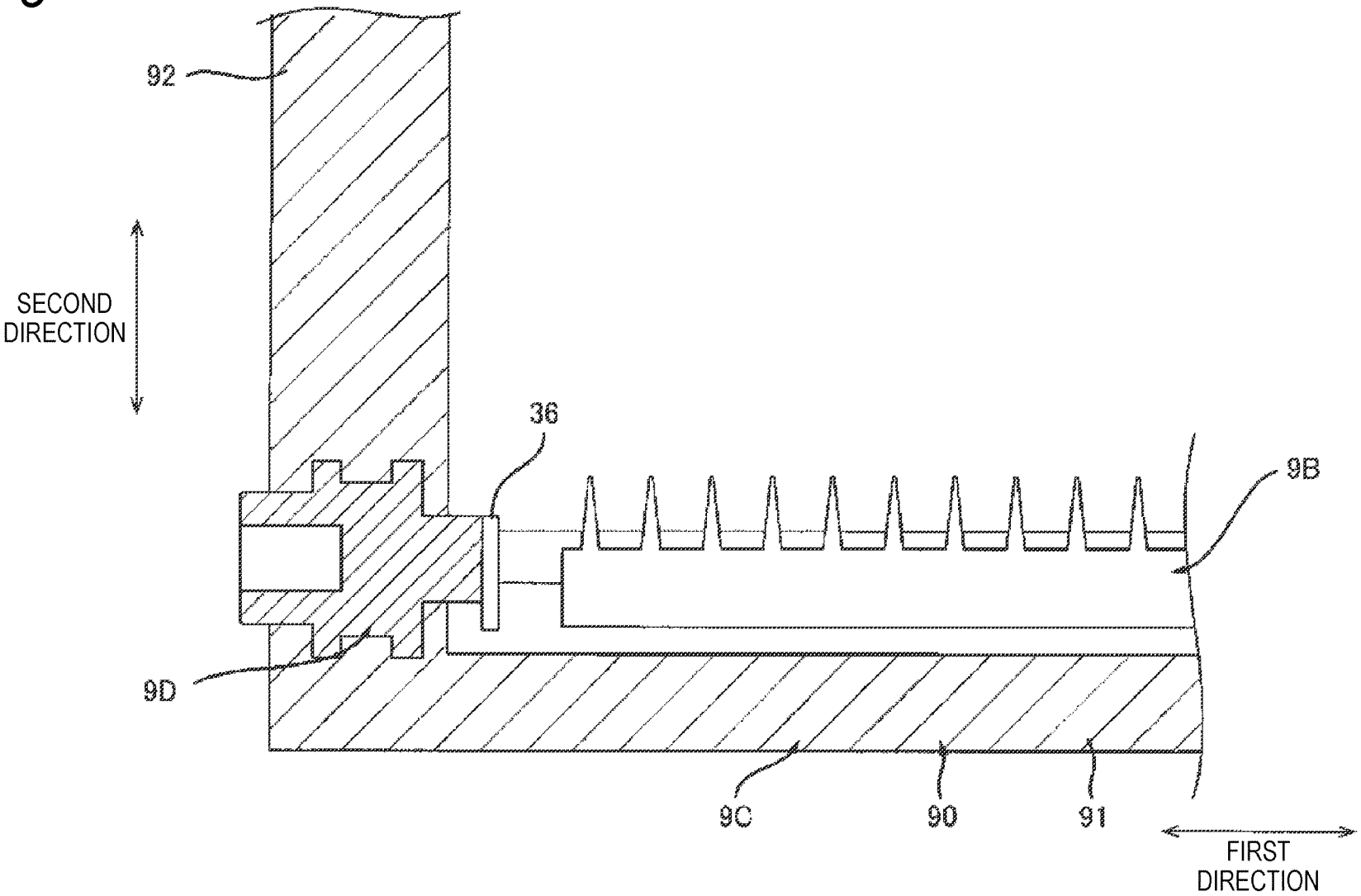
FIG. 5 illustrates electrical connection between a connection terminal of the opposite electrode and a power supply of the image forming apparatus.

Specifically, as shown in FIG. 5, the fixing device 9 includes a frame 9C and an electrode 9D.

The frame 9C has an accommodation unit 90. The accommodation unit 90 can accommodate the fixing solution sprayed from the nozzle unit 9A. The accommodation unit 90 has a bottom wall 91 and a sidewall 92. The bottom wall 91 is located on an opposite side to the nozzle unit 9A with respect to the opposite electrode 9B in the second direction. The sidewall 92 extends from the bottom wall 91 in the second direction. The opposite electrode 9B is attached to the bottom wall 91.

The electrode 9D is attached to the sidewall 92. The electrode 9D is electrically connected to the power supply P2 (refer to FIG. 1) of the image forming apparatus 1. The connection terminal 36 is in contact with the electrode 9D. Thereby, the connection terminal 36 is electrically connected to the power supply P2 of the image forming apparatus 1 via the electrode 9D. Thereby, the voltage is applied to the opposite electrode 9B by the electrode 9D.

3. Operational Effects

According to the fixing device 9, as shown in FIG. 3A, the opposite electrode 9B has the plurality of first projections 32. The plurality of first projections 32 extends from the opposite electrode 9B toward the nozzle unit 9A (refer to FIG. 1).

In the state where the voltage is applied to the opposite electrode 9B, the electrostatic force is concentrated on the tip end 321 of each of the plurality of first projections 32.

For this reason, it is possible to form the strong electric field at the tip end 321 of each of the plurality of first projections 32 without increasing the voltage that is applied to the opposite electrode 9B.

The plurality of first projections 32 are aligned in the first direction.

For this reason, it is possible to stably attract the fixing solution sprayed from each of the plurality of nozzles 22 toward the opposite electrode 9B by the strong electric field formed in the first direction.

As a result, even in a case where the sheet S is electrically charged, it is possible to stably provide the fixing solution sprayed from each of the plurality of nozzles 22 to the sheet S.

In addition, according to the fixing device 9, as shown in FIG. 4A, each of the plurality of first projections 32 is tapered from the first flat plate 31 toward the nozzle unit 9A in the second direction.

Thereby, the electrostatic force can be further concentrated on the tip end 321 of each of the plurality of first projections 32.

Further, according to the fixing device 9, as shown in FIG. 3A, each of the plurality of connection plates 35 is provided to electrically connect the first flat plate 31 and the second flat plate 33 each other.

Thereby, in the state where the voltage is applied to the opposite electrode 9B, the voltage of the first flat plate 31 and the voltage of the second flat plate 33 are the same.

As a result, it is possible to form the electric field of the uniform intensity by the plurality of first projections 32 and the plurality of second projections 34.

In addition, according to the fixing device 9, as shown in FIG. 3B, the tip end 321 of each of the plurality of first projections 32 is located between the nozzle unit 9A (refer to FIG. 1) and the connection terminal 36 in the second direction.

For this reason, in the state where the voltage is applied to the opposite electrode 9B, the fixing solution sprayed from each of the plurality of nozzles 22 is more attracted to the tip end 321 of each of the plurality of first projections 32 than the connection terminal 36.

In addition, according to the fixing device 9, as shown in FIG. 4A, the number of the plurality of first projections 32 is larger than the number of the plurality of nozzles 22.

Thereby, the fixing solution sprayed from the plurality of nozzles 22 can be securely attracted toward the opposite electrode 9B.

4. Modified Examples

Modified examples are described with reference to FIGS. 6A to 9. Note that, in the modified examples, the same members as the above embodiment are denoted with the same reference signs, and the descriptions thereof are omitted.

Figure 6A:
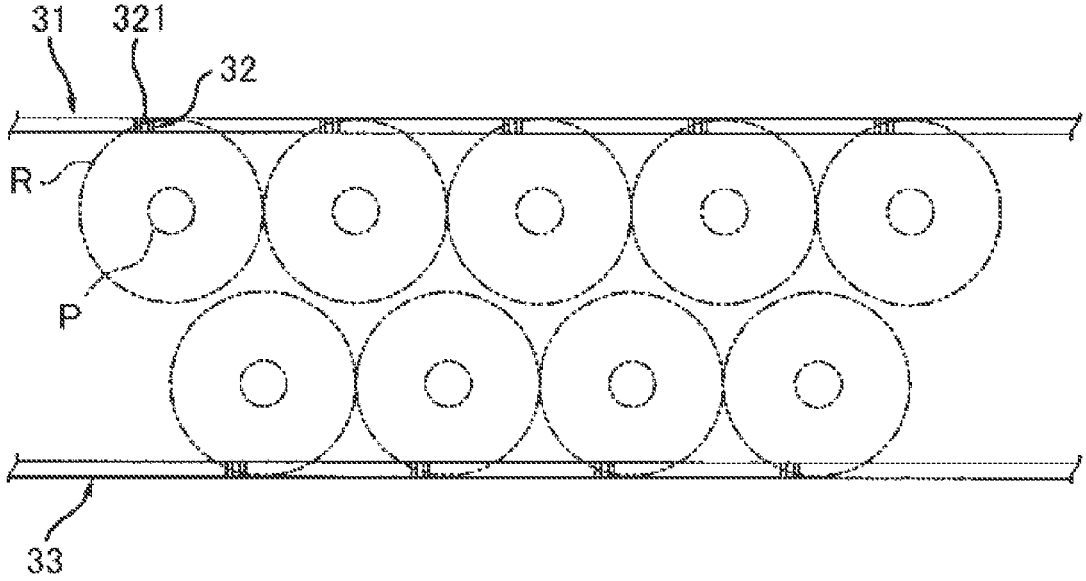
FIG. 6A illustrates a first modified example.

(1) As shown in FIG. 6A, the plurality of first projections 32 and the plurality of second projections 34 may not include the opposite projection 32A that faces the nozzle 22 in the second direction. The plurality of first projections 32 and the plurality of second projections 34 may be within the ranges R in which the fixing solution is sprayed from the nozzles 22 and may not be within the projection planes P of the nozzles 22.

Figure 6B:
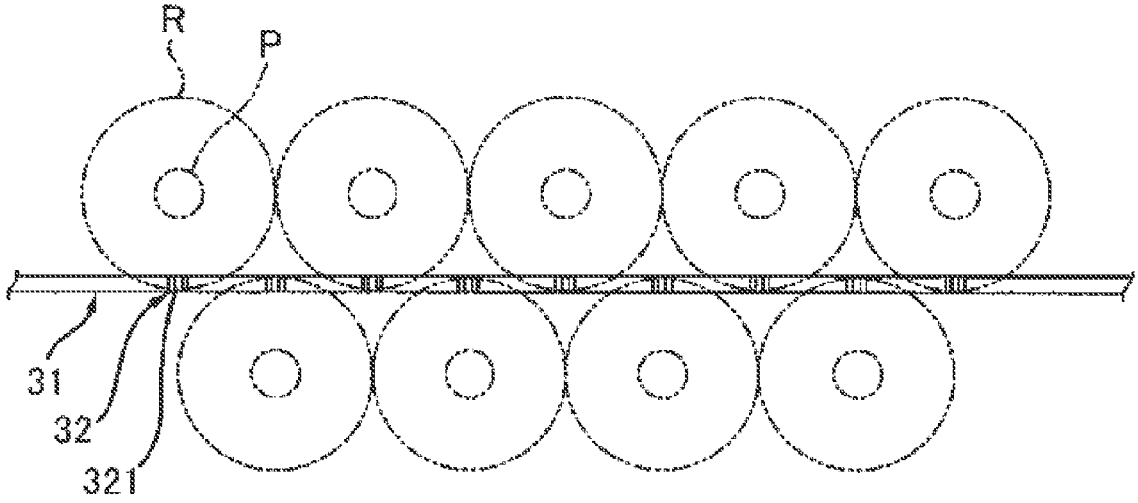
FIG. 6B illustrates a second modified example.

(2) As shown in FIG. 6B, the opposite electrode 9B may not have the second flat plate 33.

Figure 7:
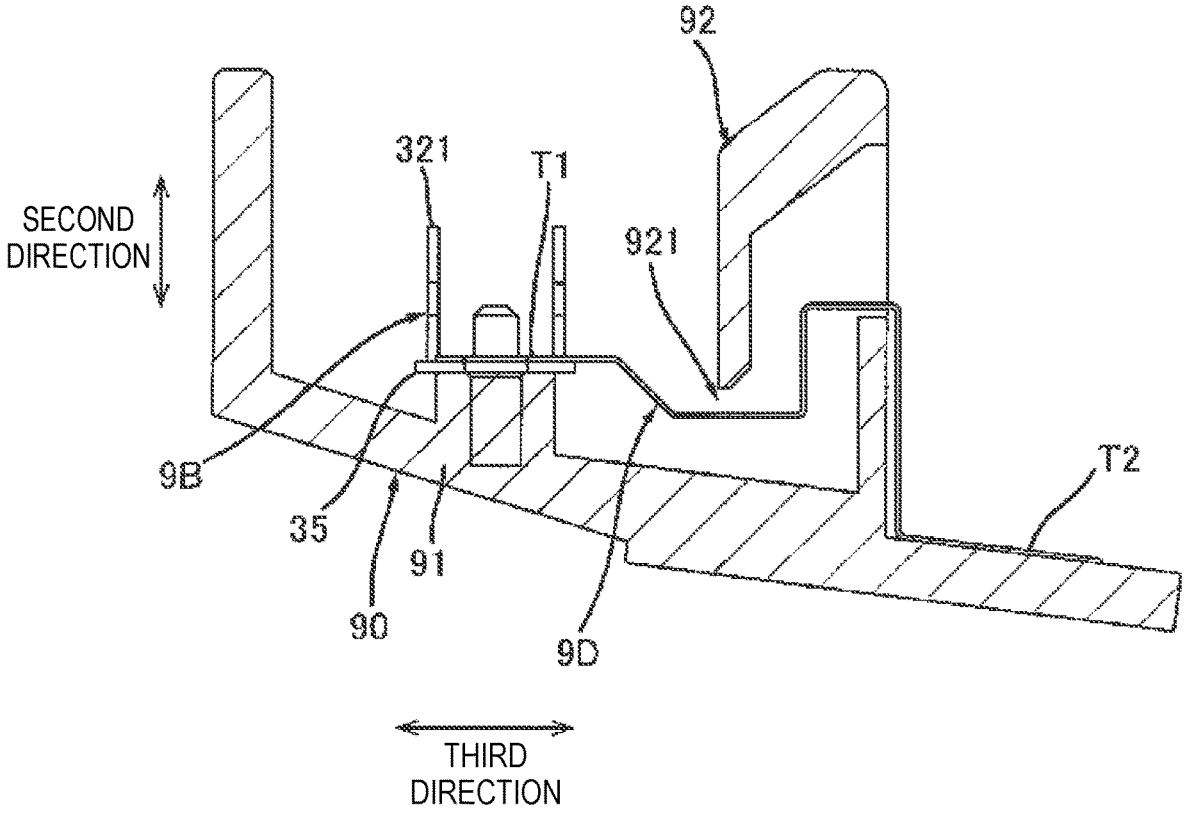
FIG. 7 is a cross-sectional view taken along a line A-A of FIG. 8, illustrating a third modified example.
Figure 8:
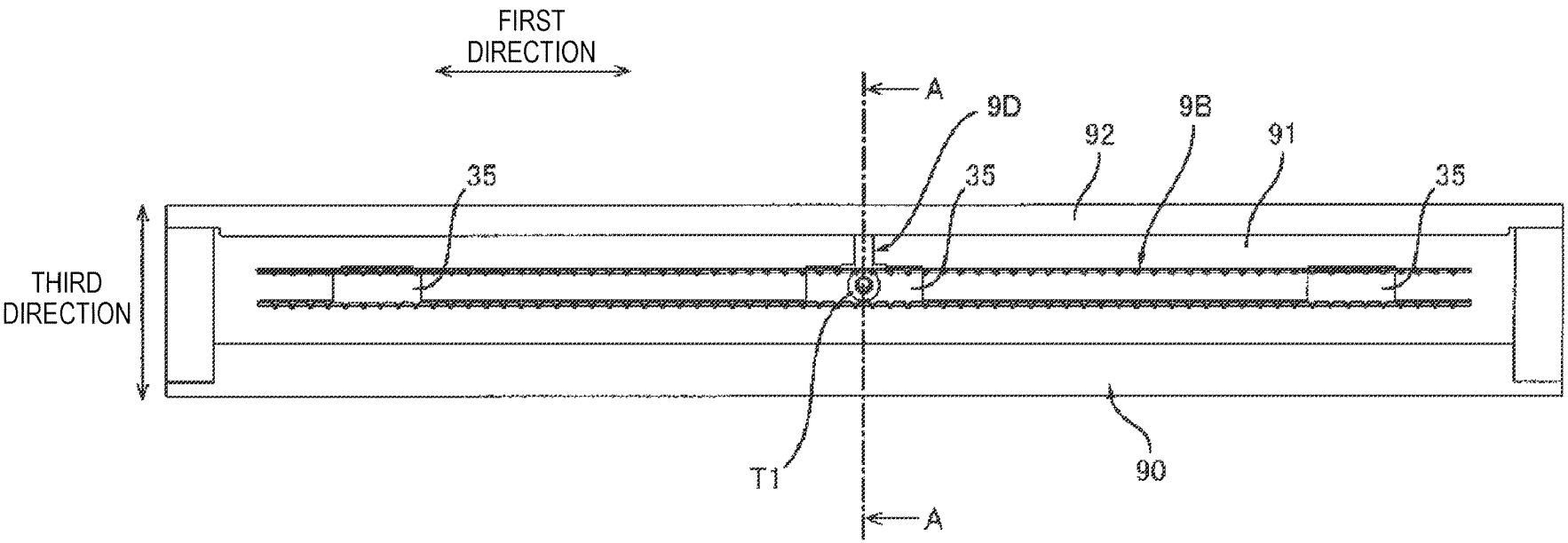
FIG. 8 illustrates the third modified example, together with FIG. 7.

(3) As shown in FIGS. 7 and 8, the electrode 9D may not be attached to the sidewall 92 of the accommodation unit 90. The sidewall 92 has an opening 921. The electrode 9D passes through the opening 921, and is electrically connected to the power supply P2 of the image forming apparatus 1 outside the accommodation unit 90. In the state where the electrode 9D passes through the opening 921, the electrode 9D is spaced from the sidewall 92.

Specifically, the electrode 9D extends in the third direction. The third direction is a direction in which the sheet S passes between the nozzle unit 9A and the opposite electrode 9B. The third direction intersects with both the first direction and the second direction. The third direction is preferably orthogonal to both the first direction and the second direction. The electrode 9D has a first terminal T1 and a second terminal T2.

Figure 9:
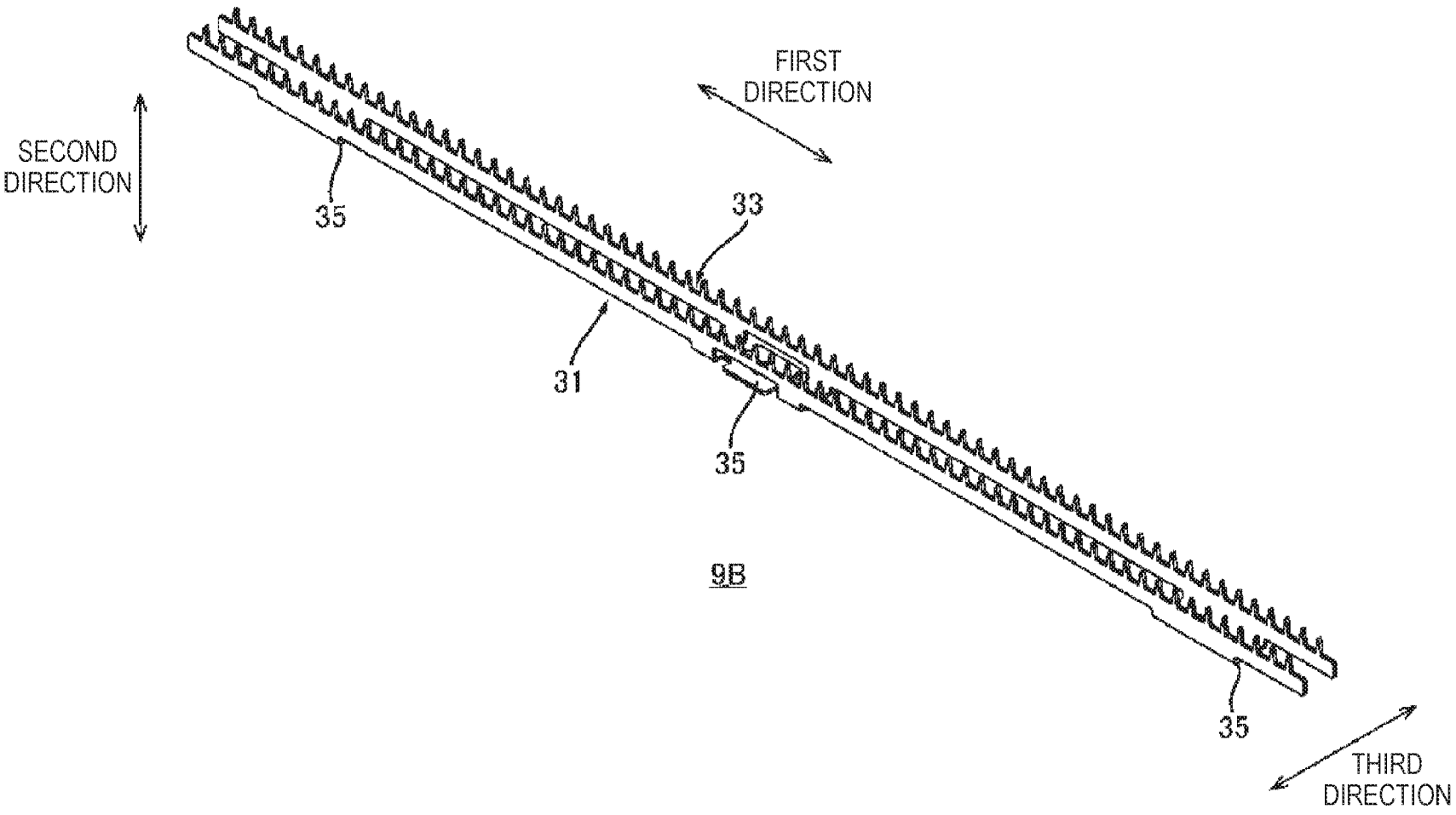
FIG. 9 is a perspective view of an opposite electrode of the third modified example.

The first terminal T1 is located inside the accommodation unit 90. The first terminal T1 is electrically connected to the opposite electrode 9B inside the accommodation unit 90. The first terminal T1 is in contact with a central portion of the opposite electrode 9B in the first direction. The first terminal T1 is in contact with the connection plate 35 of the opposite electrode 9B. In a state where the first terminal T1 is in contact with the connection plate 35 of the opposite electrode 9B, the first terminal T1 is located more distant from the nozzle unit 9A than the tip end 321 of each of the plurality of first projections 32 in the second direction. In other words, in the state where the first terminal T1 is in contact with the connection plate 35 of the opposite electrode 9B, the tip end 321 of each of the plurality of first projections 32 is located between the nozzle unit 9A and the first terminal T1 in the second direction. Note that, in this modified example, as shown in FIG. 9, the opposite electrode 9B is not provided with the connection terminal 36.

The second terminal T2 is located outside the accommodation unit 90. The second terminal T2 is located distant from the first terminal T1. The second terminal T2 is electrically connected to the power supply P2 of the image forming apparatus 1 outside the accommodation unit 90.

In this modified example, as shown in FIG. 7, since the electrode 9D is spaced from the sidewall 92, it is possible to suppress the sidewall 92 from being electrically charged due to the voltage applied to the opposite electrode 9B.

For this reason, it is possible to suppress the mists of the fixing solution sprayed from the nozzle unit 9A from being attracted to the sidewall 92.

As a result, the nozzle unit 9A can stably spray the fixing solution toward the opposite electrode 9B.

What is claimed is:

1. A fixing device provided to fix a toner image on a sheet, the fixing device comprising:

a nozzle unit that sprays a fixing solution to the sheet on which the toner image is formed, wherein the nozzle unit comprises a housing capable of accommodating the fixing solution and a plurality of nozzles provided to discharge the fixing solution in the housing; and an opposite electrode located at an interval from the nozzle unit, a voltage being applied to the opposite electrode, wherein the opposite electrode comprises:

a first flat plate extending in a first direction; and a plurality of first projections aligned in the first direction and extending from the first flat plate in a second direction that is a direction facing from the opposite electrode toward the nozzle unit, and wherein a number of the plurality of first projections is larger than a number of the plurality of nozzles.

2. The fixing device according to claim 1, wherein the plurality of first projections includes opposite projections that face the nozzles in the second direction and non-opposite projections that do not face the nozzles in the second direction.

3. The fixing device according to claim 1, wherein each of the plurality of first projections is tapered from the first flat plate toward the nozzle unit in the second direction.

4. The fixing device according to claim 3, wherein each of the plurality of first projections is an isosceles triangle flat plate.

5. The fixing device according to claim 3, wherein a tip end of each of the plurality of first projections has an arc shape.

6. The fixing device according to claim 4, wherein a tip end of each of the plurality of first projections has an arc shape.

7. The fixing device according to claim 1, wherein the housing has an accommodation unit capable of accommodating the fixing solution sprayed from the nozzle unit, where the accommodation unit has a bottom wall located on an opposite side to the nozzle unit with respect to the opposite electrode in the second direction and a sidewall extending from the bottom wall in the second direction, the opposite electrode being attached to the bottom wall; and an electrode provided to apply a voltage to the opposite electrode, and having a first terminal electrically connected to the opposite electrode inside the accommodation unit and a second terminal located distant from the first terminal and electrically connected to a power supply of an image forming apparatus outside the accommodation unit, wherein the sidewall has an opening, and in a state where the electrode passes through the opening, the electrode is spaced from the sidewall.

8. The fixing device according to claim 7, wherein a tip end of each of the plurality of first projections is located between the nozzle unit and the first terminal in the second direction.

9. The fixing device according to claim 1, wherein the opposite electrode is made of metal.

10. A fixing device provided to fix a toner image on a sheet, and comprising a nozzle unit that sprays a fixing solution to the sheet on which the toner image is formed and an opposite electrode located at an interval from the nozzle unit, a voltage being applied to the opposite electrode, wherein the opposite electrode comprises:

a first flat plate extending in a first direction;

a second flat plate located distant from the first flat plate in a third direction and extending in the first direction;

a plurality of first projections aligned in the first direction and extending from the first flat plate in a second direction that is a direction facing from the opposite electrode toward the nozzle unit, a plurality of second projections aligned in the first direction and extending from the second flat plate toward the nozzle unit in the second direction; and a connection plate provided to electrically connect the first flat plate and the second flat plate each other, wherein the first direction intersects with the third direction that is a direction in which the sheet is conveyed from a photosensitive drum of an image forming apparatus toward the fixing device, and the second direction intersects with both the first direction and the third direction.

11. The fixing device according to claim 10, wherein the photosensitive drum enables to rotate about an axis extending in the first direction.

12. The fixing device according to claim 1, wherein the opposite electrode further comprises a connection terminal electrically connected to a power supply of an image forming apparatus and located at one end portion of the opposite electrode in the first direction.

13. The fixing device according to claim 12, wherein a tip end of each of the plurality of first projections is located between the nozzle unit and the connection terminal in the second direction.

14. A fixing device provided to fix a toner image on a sheet, the fixing device comprising:

a nozzle unit that sprays a fixing solution to the sheet on which the toner image is formed, wherein the nozzle unit comprises a housing capable of accommodating the fixing solution and a plurality of nozzles provided to discharge the fixing solution in the housing; and an opposite electrode located at an interval from the nozzle unit, a voltage being applied to the opposite electrode, wherein the opposite electrode comprises:

a first flat plate extending in a first direction; and a plurality of first projections aligned in the first direction and extending from the first flat plate in a second direction that is a direction facing from the opposite electrode toward the nozzle unit, and wherein the plurality of first projections includes opposite projections that face the nozzles in the second direction and non-opposite projections that do not face the nozzles in the second direction.

* * * * *